United States Patent [19]

Ivey

[11] Patent Number: 4,765,466

[45] Date of Patent: Aug. 23, 1988

[54] FOLIO OF CARD MATERIAL

[76] Inventor: Charles W. Ivey, 356 Glenwood Drive, Glen Lorne, Harare, Zimbabwe

[21] Appl. No.: 10,044

[22] Filed: Feb. 2, 1987

[30] Foreign Application Priority Data

Feb. 13, 1986 [GB] United Kingdom ..... 8603554

[51] Int. Cl.[4] ..... B65D 75/06; B65D 85/672

[52] U.S. Cl. ..... 206/232; 206/387; 206/472

[58] Field of Search ..... 206/232, 472, 387; 229/72, 87.5; 281/31

[56] References Cited

U.S. PATENT DOCUMENTS

| | | | |
|---|---|---|---|
| 620,984 | 3/1899 | Smith | 229/87.5 |
| 2,224,350 | 12/1940 | Johnston | 281/31 |
| 3,540,646 | 11/1970 | Kizler | 229/72 |
| 4,485,962 | 12/1984 | Farley | 229/72 |

FOREIGN PATENT DOCUMENTS

| | | | |
|---|---|---|---|
| 0257684 | 3/1912 | Fed. Rep. of Germany | 229/87.5 |
| 1177554 | 4/1959 | France | 206/474 |
| 2305923 | 10/1976 | France | 206/472 |
| 0099524 | 6/1923 | Switzerland | 206/472 |
| 0014347 | of 1911 | United Kingdom | 229/87.5 |

*Primary Examiner*—Jimmy G. Foster

*Attorney, Agent, or Firm*—Benjamin J. Barish

[57] ABSTRACT

A folio of card material for receiving an article, comprising: a sheet folded to form panels, one overlying another; a surface of one of said panels being provided with a pocket for receiving the article, the pocket being expansible from a flattened condition such that, on insertion of the article, the pocket expands in volume to receive the article.

4 Claims, 2 Drawing Sheets

FOLIO OF CARD MATERIAL

BACKGROUND OF THE INVENTION

This invention relates to a folio of card material.

It is known to provide gift tokens in the form of greeting cards. Generally, a gift token comprises a sheet of card material which is folded to provide a folio comprising a rear panel and a cover. The cover is folded onto an adjacent surface of the rear panel. The adjacent surface generally has applied thereto an adhesive stamp on which is printed indicia indicating a value. On presentation of the token to an authorised dealer, the token can be exchanged for an article of then indicated value.

Although such tokens may have a similar appearance to greeting cards in that they may be provided with similar graphic representations, it may be considered more appropriate on a particular occasion to provide a greetings card accompanied by a gift rather than a token which can be exchanged for an article which could have been the gift.

SUMMARY OF THE INVENTION

An object of the present invention is to provide a folio of card material which is adapted to carry a gift and yet, when in a storage or display condition not included with the gift, is adapted to be folded in a flattened condition as with a greeting card.

According to the present invention, there is provided a folio of card material for receiving an article, comprising a sheet folded to form two panels, one overlying another, hinged to a center spine; and a pocket applied to the inner surface of one of the panels for receiving the article. The pocket is expansible from a flattened condition such that, on insertion of the article, the pocket expands in volume to receive the article. More particularly, the pocket is of substantially rectangular configuration, and has an outer edge substantially flushed with the outer edges of the two panels in their folded condition, an inner edge spaced from the center spine, and upper and lower edges spaced inwardly from the upper and lower edges of the two panels in their folded condition.

According to further features of the invention, the pocket is defined by a second sheet of card material of smaller dimensions than the panels and is secured to the inner face of one of the panels by extensions formed on all sides of the second sheet except that facing the center spine. Each of the extensions is formed with a first fold-line hinge at its juncture with the second sheet, a second fold-line hinge at its juncture with the first sheet, and a third fold-line hinge between the first and second fold-line hinges.

According to still further features in the described preferred embodiment, the extension of the second sheet on the side opposite to that without an extension is formed with a slot, and the side of the panel opposite to that to which the second sheet is secured is formed with a clasp receivable in the slot. In addition, the side of the second sheet without an extension is formed with a semi-circular cut-out.

The folio constructed according to the above features is adapted to carry a gift in its pocket, and to be folded flat, resembling a greeting card, when in a storage or display condition not including the gift.

DESCRIPTION OF A PREFERRED EMBODIMENT

Figure 3:
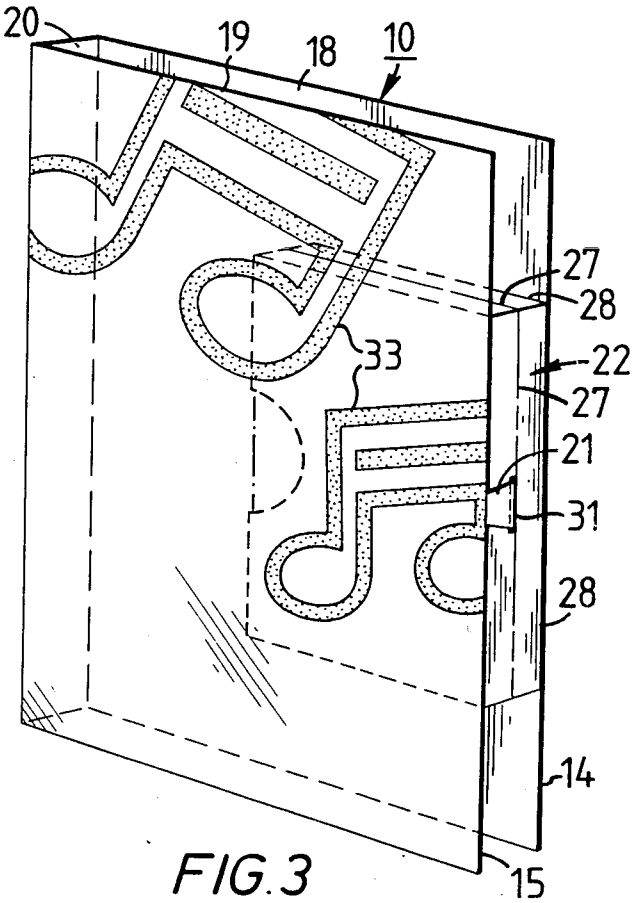
FIG. 3 is a perspective view of the folio containing the article and shown in a closed condition.

Referring to the drawings, there is shown a folio 10 comprising an elongate rectangular sheet 11 of stiff card material having opposite-facing parallel edges 12, 13 of greater dimension than the two remaining parallel edges 14, 15. The sheet 11 is provided with spaced parallel fold lines defining hinges 16, 17 extending from one to the other of the long edges 12, 13 and parallel to the short edges 14, 15. Sheet 11 thus defines a rear panel 18, a front panel 19 and a center spine 20, the spine being pivotally connected to the rear and front panels 18, 19 by means of the hinges 16, 17 respectively. Sheet 11 also is provided with a clasp 21 which extends from the short edge 15.

The rear panel 18 has mounted on the surface thereof a rectangular pocket or housing 22 comprising a front panel 23 of stiff card material of rectangular configuration but of smaller dimensions than panels 18 and 19. Panel 23 is provided with spaced parallel extensions on three sides, i.e., on all sides except that facing the spine 20. These extensions define side walls 24, 25 and a base 26. The side walls 24, 25 and the base 26 are each provided with a central, longitudinally-extending fold line defining a hinge 27. Each side wall 24, 25 is connected to the rear panel 18 by means of a fold-line hinge 28 and is connected to the front panel 23 of pocket 22 by means of a fold-line hinge 29. The front panel 23 of pocket 22 is provided with a semi-circular cut-out 30 at an edge thereof extending parallel to the base 26. The base 26 is provided with a centrally located elongated slot 31 extending parallel to and adjacent the hinge 27 of the base 26.

Pocket 22 is of card material. The longitudinal marginal edges of its side walls 24, 25 and base 26 extending adjacent the hinges 28 are turned inwardly as shown at 24', 25' and 26', respectively (FIG. 2), and are secured by adhesive to the adjacent surface of the rear panel 18.

The dimensions of pocket 22 are such that, when expanded with the side walls 24, 25 and the base 26 extending in planes perpendicular to the rear panel 18, the internal volume of pocket 22 is sufficient to accommodate a rectangular article 32, such as a cassette comprising a tape spool.

Hinges 16, 17, 27, 28 and 29 are formed by slitting the material of the sheet 11 and pocket 22 such that the fibres of the card are only partically severed and thereby weakened, and then folding the card along these weakened lines.

Surfaces of the sheet 11 and pocket 22 may be printed with graphic representations, as shown at 33.

Figure 1:
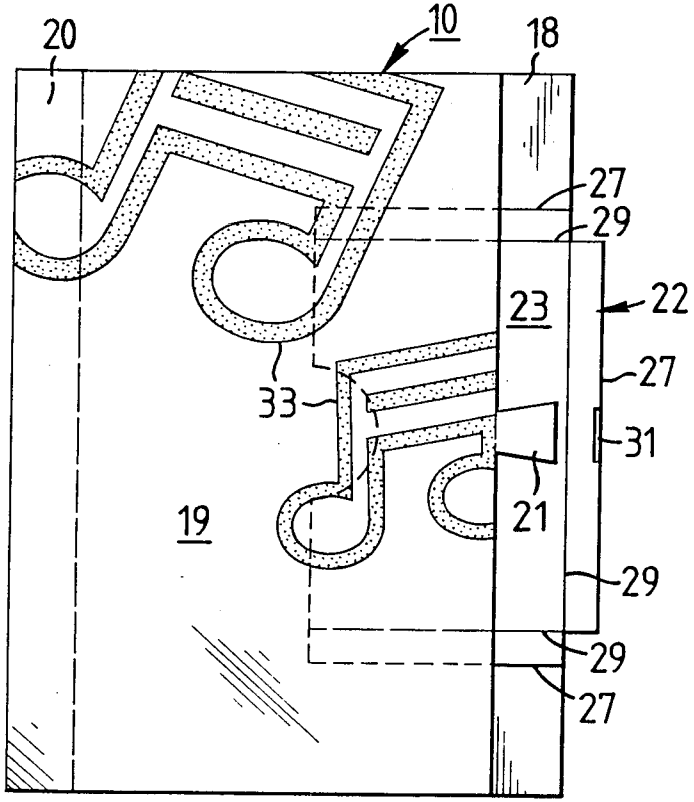
FIG. 1 is a plan view of a folio in accordance with the present invention when in a flattened condition for storage and display.

The folio 10 is stored with the pocket 22 flattened and without an article 32 being received in the pocket, i.e. with the side walls 24, 25 and the base 26 of pocket 22 pivoted along the hinges 27, 28, 29 so that the front panel 23 of pocket 22 lies against the rear panel 18, as shown in FIG. 1. Also in the storage position, the spine 20 is folded along the hinge 16 so that the front panel 19 lies on top of the front panel 23 of pocket 22 and the rear panel 18, also as shown in FIG. 1.

In the storage position shown in FIG. 1, the folio may be placed on a rack in a retail establishment for display.

The folio 10 may be selected from a plurality of similar folios 10 each having different graphical representations 33 thereon but otherwise similar one to another. An article 32 may then be selected from a range of such articles.

Figure 2:
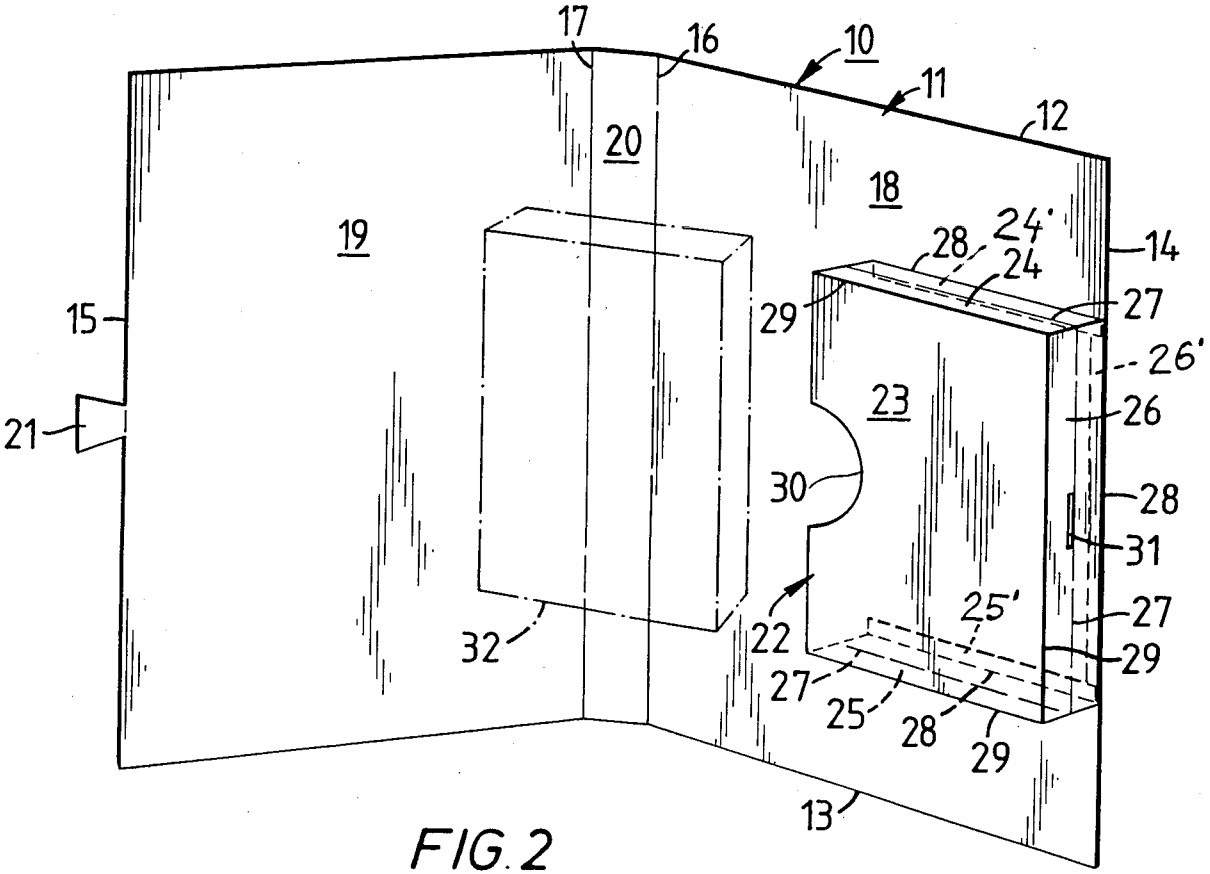
FIG. 2 is a perspective view of the folio in an open condition showing insertion of an article into a pocket thereof.

The front panel 19 then is pivoted relative to the hinge 16 from the positin shown in FIG. 1 to the position shown in FIG. 2, to thereby expand pocket 22. The selected article 32 is inserted under the front panel 23 of pocket 22 causing the front panel 23 of the pocket to move away from the rear panel 18 and the side walls 24, 25 and the base 26 to pivot relative to the hinges 27, 28 and 29 to a position in which the side walls 24, 25 and the base 26 extend perpendicular to an adjacent surface of the rear panel 18, as shown in FIG. 2.

When the article 32 is fully inserted into pocket 22, the front panel 19 is pivoted relative to the hinge 16 so as to cover pocket 22 and the rear panel 18, as shown in FIG. 3. The combination is secured by inserting the clasp 21 through the cut-out 30, also as shown in FIG. 3.

While the invention is described with respect to one preferred embodiment, it will be appreciated that many variations and modifications may be made.

What is claimed is:

1. A folio of card material for receiving an article, comprising: a sheet folded to form two panels, one overlying another, hinged to a center spine; and a pocket applied to the inner surface of one of said panels for receiving the article, said pocket being expansible from a flattened condition such that, on insertion of the article, the pocket expands in volume to receive the article; said pocket being of substantially rectangular configuration and having an outer edge substantially flush with the outer edges of the two panels in their folded condition, an inner edge spaced from said center spine, and upper and lower edges spaced inwardly from the upper and lower edges of the two panels in their folded condition; said pocket being defined by a second sheet of card material of smaller dimensions than said panels and being secured to the inner face of one of said panels by extensions formed on all sides of the second sheet except that facing said spine; each of said extensions being formed with a first fold-line hinge at its juncture with the second sheet, a second fold-line hinge at its juncture with the first sheet, and a third fold-line hinge between said first and second fold-line hinges, such as to define said expansible pocket; the extension of the second sheet on the side opposite to that without an extension being formed with a slot, and the side of the panel opposite to that to which that second sheet is secured being formed with a clasp receivable in said slot.

2. The folio according to claim 1, wherein the side of the second sheet without an extension is formed with a semi-circular cut-out.

3. A folio for receiving an article, comprising:

a first sheet of stiff material of rectangular configuration defining a pair of long sides and a pair of short sides;

said sheet being further formed with a pair of fold lines parallel to its short sides defining two panels of the same size and configuration hinged to a center spine;

a second sheet of stiff material of rectangular configuration, said second sheet being of rectangular configuration of smaller dimensions than said panels and having an outer edge substantially flush with the outer edges of the two panels in their folded condition, an inner edge spaced from said center spine, and upper and lower edges spaced inwardly from the upper and lower edges of the two panels in their folded condition; said second sheet being secured to the inner face of one of said panels by extensions formed on all sides of the second sheet except that facing said spine;

each of said extensions being formed with a first fold line hinge at its juncture with the second sheet, a second fold-line hinge at its juncture with the first sheet, and a third fold-line hinge between said first and second fold-line hinges, such as to define a pocket expansible from a flattened condition to an expanded condition for receiving the article; said extension of the second sheet on the side opposite to that without an extension being formed with a slot, and the side of the panel opposite to that to which that second sheet is secured being formed with a clasp receivable in said slot.

4. The folio according to claim 3, wherein the side of the second sheet without an extension is formed with a semi-circular cut-out.

* * * * *